United States Patent [19]

Miller et al.

[11] Patent Number: 4,617,856

[45] Date of Patent: Oct. 21, 1986

[54] SWASH PLATE COMPRESSOR HAVING INTEGRAL SHOE AND BALL

[75] Inventors: Gary T. Miller, Amherst, N.Y.; Ronald E. Marker, New Lebanon, Ohio; Richard L. Marker, Lockport, N.Y.

[73] Assignee: General Motors Corporation, Detroit, Mich.

[21] Appl. No.: 818,014

[22] Filed: Jan. 13, 1986

[51] Int. Cl.[4] ..... F04B 1/16; F01B 3/02; F16C 5/00

[52] U.S. Cl. ..... 92/71; 417/269; 384/42; 384/908; 74/60

[58] Field of Search ..... 74/DIG. 10, 60; 92/71, 92/84; 417/269, 270; 308/DIG. 3, DIG. 7, 3 C; 384/203, 220

[56] References Cited

U.S. PATENT DOCUMENTS

| | | | |
|---|---|---|---|
| 2,709,339 | 5/1955 | Edelmann | 74/DIG. 10 |
| 3,124,971 | 3/1964 | Peters et al. | 74/DIG. 10 |
| 3,249,375 | 5/1966 | Herbenar | 384/203 |
| 3,261,216 | 7/1966 | Woolfenden | 74/60 |
| 3,357,363 | 12/1967 | Raymond | 417/270 |
| 3,410,477 | 11/1968 | Hartley | 417/534 |
| 3,450,058 | 6/1969 | Stern | 92/71 |
| 3,746,475 | 7/1973 | Johnson | 417/269 |
| 4,347,046 | 8/1982 | Brucken et al. | 417/269 |
| 4,505,187 | 3/1985 | Aragona | 417/269 |

*Primary Examiner*—William L. Freeh
*Attorney, Agent, or Firm*—R. L. Phillips

[57] ABSTRACT

A swash plate compressor is disclosed having integral plastic ball and shoe parts providing the drive between the opposite sides of the swash plate and the inner ends of double-ended pistons that straddle the plate.

2 Claims, 3 Drawing Figures

SWASH PLATE COMPRESSOR HAVING INTEGRAL SHOE AND BALL

TECHNICAL FIELD

This invention relates to swash plate compressors and more particularly to the drive arrangement therein between the swash plate and the pistons.

BACKGROUND OF THE INVENTION

In swash plate compressors such as used in vehicle air conditioning systems, the drive arrangement between the swash plate and the pistons normally comprises a ball mounted in a socket in each piston and also in a socket in a shoe having a flat side that is slidably engaged by one side of the swash plate. However, it has also been proposed to employ a semi-spherical shoe that combines these parts. Typically, the pistons are made of aluminum, the balls and semi-spherical shoes are made of steel and the shoes are made of brass. For proper operation, the fit between the piston, ball, shoe (or semi-spherical shoe), and swash plate must be held very close. In practice, this has been accomplished by machining, gauging, and sorting the shoes into certain dimensional increments or classes. For example, these increments may be as small as 0.0002" and extensive in number depending on the manufacturing tolerances. In assembly, the balls are assembled in the pistons and the gap between them is measured. The thickness of the swash plate is also measured and with these two dimensions the proper class shoe is then selected for each piston. The manpower and equipment required to sort, gauge and select are major manufacturing costs. Furthermore, the inventory of shoes must be kept high to maintain a sufficient number of parts in all the classes to meet anticipated requirements. There is also an additional problem with the steel semi-spherical shoes in that it is far more difficult in mass production to produce and maintain tolerances of a flat-sided ball as compared to a simple round ball.

Then in the field there may occur such problems as noise and smearing by the brass shoes. Noise is attributed to loss of fit from either misassembly, wear, or the steel balls coining into the aluminum pistons. When this occurs, the loose assembly will be slapped during compression rather than riding on the swash plate. And this situation will not improve but will degenerate. Smeared brass on the other hand occurs during a dry start-up when no lubrication is present between the swash plate and the shoes resulting in brass from the shoes being deposited on the steel plate and forming a brass-on-brass interface with a potential for galling.

SUMMARY OF THE INVENTION

The present invention provides a very simple solution to both the manufacturing and field problems by replacing the conventionally used steel ball and brass shoe or proposed semi-spherical steel shoe with an integral or one-piece ball and shoe made of plastic having a coefficient of thermal expansion greater than and a coefficient of friction lower than the brass and steel pieces it replaces. The shoe portion is of cylindrical shape with a flat end and the ball portion has a radius slightly smaller than that of the socket in the piston in which it is received so as to provide the part with sufficient compliance as to be made in a single size to fit under preload in all the compressors rather than requiring various sizes and selective fit. Moreover, it has been found that the plastic ball nosed shoe can be machined from round rod stock or injection molded and used as it comes from the mold as it does not require any grinding or other finishing.

The benefits favorably impacting both product quality and cost are thus many and include the elimination of gauging, sorting and selection and a reduction in required inventory. For example, in the case of a six-cylinder compressor with three double-ended pistons, six parts are eliminated along with the need for different size classes. Furthermore, there is the ease of manufacture whether the parts are machined from plastic rod or molded and also the ease of assembly as the pistons do not require pre-assembly with the parts for gauging. Moreover, there is reduction of compressor noise problems along with the elimination of smeared brass and a reduction in operating torque.

DESCRIPTION OF PREFERRED EMBODIMENT OF THE INVENTION

These and other objects, advantages and features of the present invention will become more apparent from the following description and drawing in which.

Figure 1:
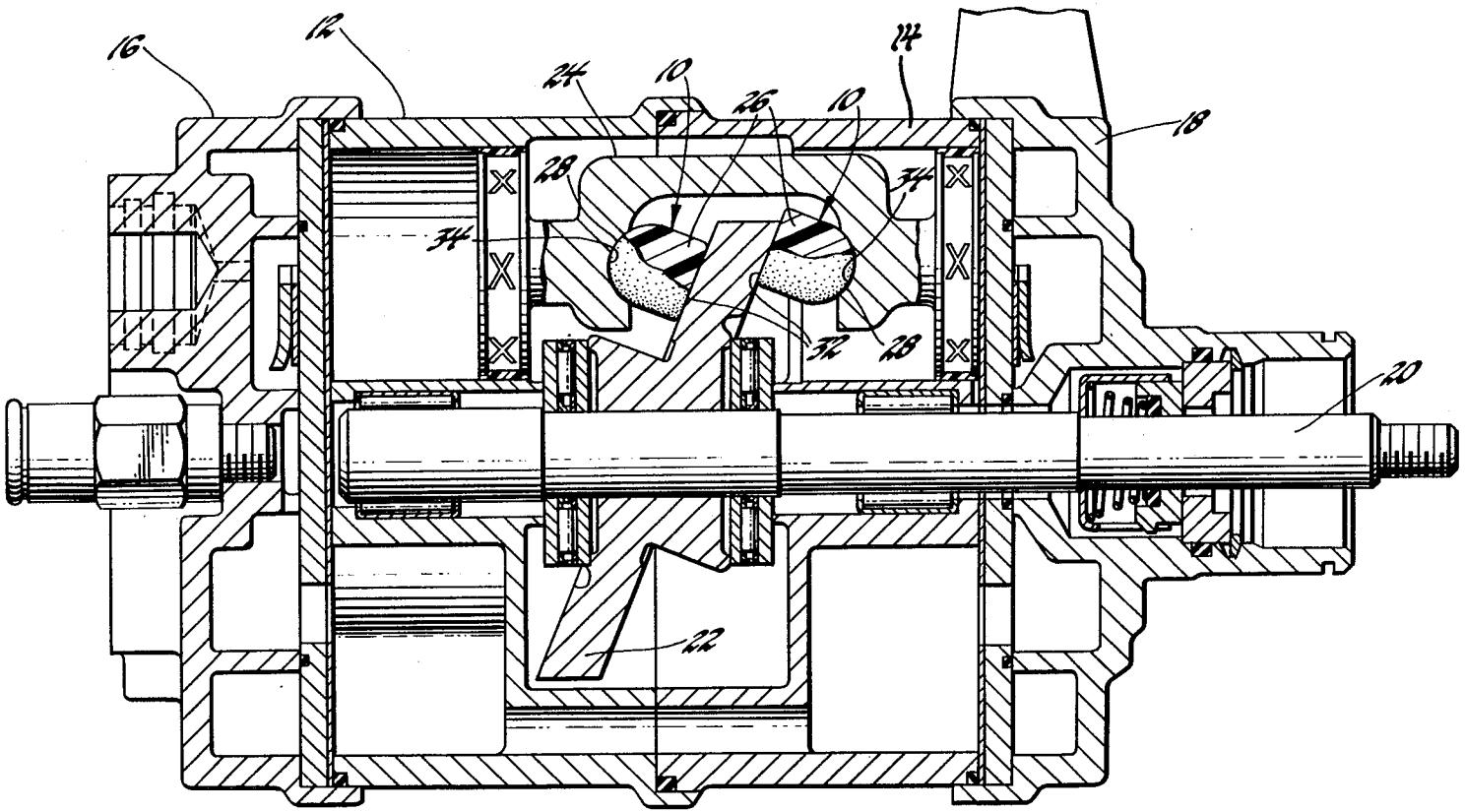
FIG. 1 is a longitudinal sectional view of a refrigerant compressor embodying the preferred construction of the present invention as intended for use in a vehicle air conditioning system.

Referring to FIG. 1, the compressor thereshown apart from the integral plastic ball and shoe parts 10 is like that disclosed in U.S. Pat. No. 4,347,046 (FIGS. 8–23) assigned to the assignee of this invention and which is hereby incorporated by reference. The compressor includes mating three-cylinder cylinder blocks 12 and 14 with heads 16 and 18 respectively, a drive shaft 20 with a swash plate 22 fixed thereto, and three double-ended pistons 24 (only one of which appears in the drawing) which are received in the cylinders and driven by the swash plate at oppositely facing sides thereof through the ball ended shoes. Apart from the ball ended shoes whose details will now be described, the other compressor structure and operation is like that in the above-mentioned patent to which reference may be made for further information thereon.

The integral plastic ball and shoe parts 10 have a cylindrical body 26 that is formed at one end with a semi-spherical shape or surface 28 whose center is on the body's axis 30 (see FIG. 2) and is formed at the other end with a flat shape or surface 32 that is perpendicular to the body axis. At each piston, the flat end 32 of each integral plastic ball and shoe part serves as a shoe against which one side of the swash plate slides as the latter is rotated while the ball end 28 is cupped in a spherical shaped socket 34 formed in the associated one of the two inner ends of the piston where the latter straddles the swash plate.

Figure 2:
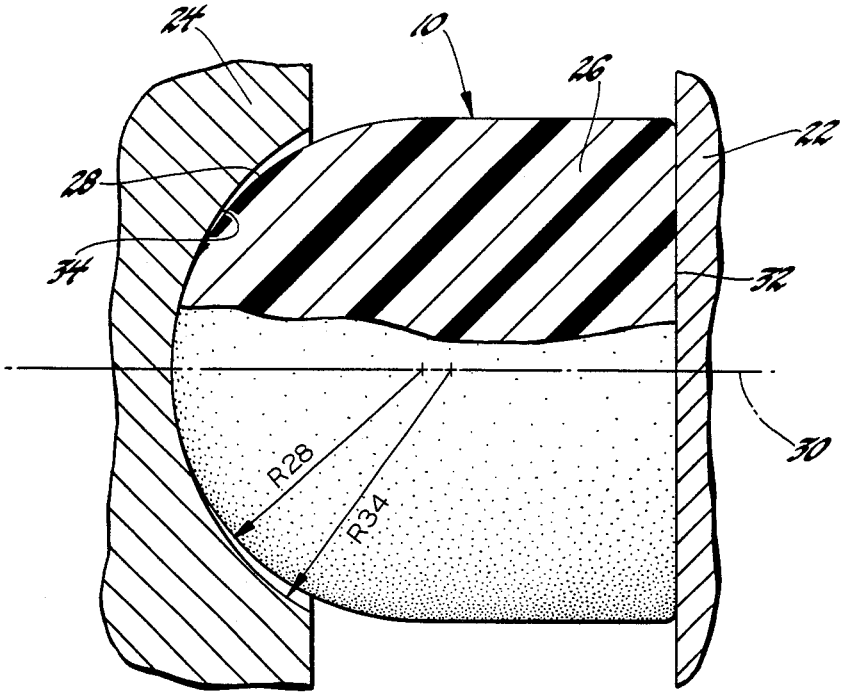
FIG. 2 is an enlarged view of one of the integral plastic ball and shoes in FIG. 1 but without the preload.
Figure 3:
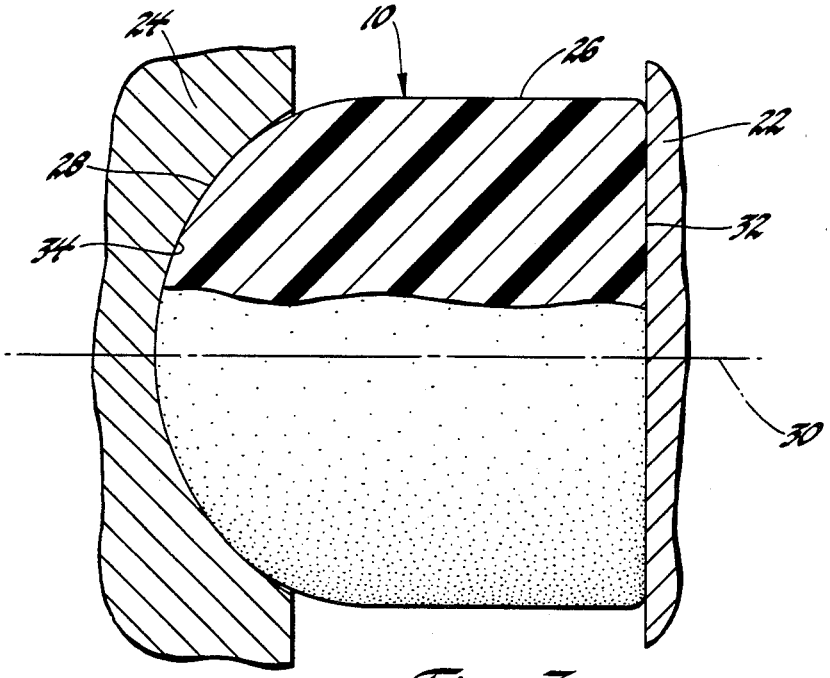
FIG. 3 is like FIG. 2 but with the preload obtained at assembly.

The integral ball and shoe parts are made of plastic with the tests thus far conducted showing the most promising results with a polyimide plastic manufactured by DuPont Company under the trade name Vespel® SP-21 and SP-211. This material has a coefficient of thermal expansion of $23\times10^{-6}$ in/in/°F. which is greater than the conventional brass and steel pieces it replaces. Furthermore, this material has a much lower coefficient of friction than brass and steel. Moreover, this material is compliant while being resistant to permanent deformation and it is these features which are utilized to allow a single class size to be used. To this end, the ball end 28 of the integral plastic ball and shoes is formed as shown in FIG. 2 with a radius R28 slightly smaller than the radius R34 of the piston socket such that the pre-load in the assembly forces the plastic material to conform to and thus tightly seat in the socket as shown in FIG. 3. And thus instead of select fitting parts, there is provided a single size integral plastic ball and shoe that is capable of varying in degree of compliance at assembly to provide the desired tight fit.

The above described preferred embodiment is illustrative of the invention which may be modified within the scope of the appended claims.

The embodiments of the invention in which an exclusive property or privilege is claimed are defined as follows:

1. A swash plate compressor having a piston driven by a swash plate through a ball and shoe arrangement characterized by the ball and shoe arrangement comprising a plastic cylindrical body having a flat surface at one end that is slidably engaged by one side of the swash plate and further having a semi-spherical surface at an opposite end that is received under preload in a semi-spherical socket in the piston, said body being made of plastic having a coefficient of thermal expansion greater than and a coefficient of friction less than steel and brass and further having a compliance while being resistant to permanent deformation such that at assembly the pre-load forces the semi-spherical end to tightly seat in the socket.

2. A swash plate compressor having a piston driven by a swash plate through a ball and shoe arrangement characterized by the ball and shoe arrangement comprising a plastic cylindrical body having a flat surface at one end that is slidably engaged by one side of the swash plate and further having a semi-spherical surface at an opposite end that is received under preload in and has a radius smaller than a semi-spherical socket in the piston, said body being made of plastic having a coefficient of thermal expansion greater than and a coefficient of friction less than steel and brass and further having a compliance while being resistant to permanent deformation such that at assembly the pre-load forces the semi-spherical end to conform to the socket.

* * * * *